US008720740B2

(12) United States Patent
Bratsch

(10) Patent No.: US 8,720,740 B2
(45) Date of Patent: May 13, 2014

(54) RECLOSABLE CLOSURE OF A LIQUID CONTAINER

(75) Inventor: Christian Bratsch, Salzburg (AT)

(73) Assignee: Xolution GmbH, München (DE)

( * ) Notice: Subject to any disclaimer, the term of this patent is extended or adjusted under 35 U.S.C. 154(b) by 266 days.

(21) Appl. No.: 13/138,711

(22) PCT Filed: Apr. 7, 2010

(86) PCT No.: PCT/EP2010/054566

§ 371 (c)(1),
(2), (4) Date: Sep. 21, 2011

(87) PCT Pub. No.: WO2010/115911

PCT Pub. Date: Oct. 14, 2010

(65) Prior Publication Data

US 2012/0138621 A1 Jun. 7, 2012

(30) Foreign Application Priority Data

Apr. 7, 2009 (AT) ..... A 550/2009

(51) Int. Cl.
*B65D 43/18* (2006.01)
*B65D 41/32* (2006.01)

(52) U.S. Cl.
USPC ..... 220/821; 220/253; 220/906; 220/716; 220/266; 220/254.4

(58) Field of Classification Search
USPC ..... 220/253, 254.4, 266, 326, 716, 780, 220/784, 786, 793, 820, 821; 215/317, 320
See application file for complete search history.

(56) References Cited

U.S. PATENT DOCUMENTS

| | | | | |
|---|---|---|---|---|
| 3,889,842 | A | 6/1975 | Bennett | |
| 4,054,228 | A | 10/1977 | Balocca et al. | |
| 4,345,695 | A | 8/1982 | Galloway et al. | |
| 4,746,032 | A | 5/1988 | Huang | |
| 5,240,132 | A * | 8/1993 | Tucker | 220/212 |
| 5,692,633 | A | 12/1997 | Gordon | |
| 6,216,904 | B1 | 4/2001 | Cagan | |

(Continued)

FOREIGN PATENT DOCUMENTS

| | | |
|---|---|---|
| DE | 19613246 | 10/1997 |
| DE | 19613256 | 10/1997 |

(Continued)

OTHER PUBLICATIONS

English Abstract FR2839950.

(Continued)

*Primary Examiner* — Anthony Stashick
*Assistant Examiner* — James N Smalley
(74) *Attorney, Agent, or Firm* — Dykema Gossett PLLC

(57) ABSTRACT

The invention relates to a reclosable closure (100) of a liquid container, in particular a beverage can (200), comprising a lid (300) that closes the liquid container by way of a flanged edge (310) and comprising a cover (400), with the lid (300) having an outlet opening (320) which can be exposed by twisting the cover (400) arranged on the lid (300), and the lid (300) comprises at least one recess (360, 361) for accommodating at least one sealing means (430) between the lid (300) and the cover (400).

11 Claims, 8 Drawing Sheets

(56) References Cited

U.S. PATENT DOCUMENTS

| | | | | |
|---|---|---|---|---|
| 6,626,314 | B1 | 9/2003 | McHenry et al. | |
| 6,763,963 | B1 | 7/2004 | Martin | |
| 7,017,769 | B1 | 3/2006 | Talmon | |
| 2003/0080130 | A1 | 5/2003 | Goetz et al. | |
| 2003/0155360 | A1 * | 8/2003 | Gotz et al. | 220/258.4 |
| 2009/0078703 | A1 * | 3/2009 | Hundeloh et al. | 220/258.5 |
| 2010/0059516 | A1 * | 3/2010 | Parker et al. | 220/268 |
| 2010/0206875 | A1 | 8/2010 | Bratsch | |

FOREIGN PATENT DOCUMENTS

| | | |
|---|---|---|
| DE | 19706112 | 4/1998 |
| DE | 19746539 | 3/1999 |
| DE | 20319105 | 4/2004 |
| EP | 0340835 | 11/1989 |
| EP | 0433502 | 6/1991 |
| EP | 1190952 | 3/2002 |
| EP | 1247752 | 10/2002 |
| FR | 2839950 | 11/2003 |
| GB | 2331284 | 5/1999 |

OTHER PUBLICATIONS

English Abstract of EP0304835.
English Abstract of DE19613246.
English Abstract of DE19613256.
English Abstract of DE19706112.
English Abstract of DE19746539.
English Abstract of DE20319105.

* cited by examiner

RECLOSABLE CLOSURE OF A LIQUID CONTAINER

BACKGROUND OF THE INVENTION

1. Field of the Invention

The invention relates to a reclosable closure of a liquid container, in particular a beverage can, which includes a lid that closes the liquid container by way of a flanged edge and a cover, the lid having an outlet opening which can be exposed by twisting the cover arranged on the lid.

2. The Prior Art

Numerous beverage cans have become known which have a reclosable pouring opening. DE 196 13 246 A1 for example discloses a closure means with substantially the same diameter which is applied to the already existing lid, which closure means closes a pouring opening disposed in the lid by twisting. Similar apparatuses where some of these closure means cover the lid only partly have been described in DE 196 13 256 B4, DE 197 06 112 C2, EP 1 247 752 B1 or U.S. Pat. No. 6,626,314 B1. The disadvantageous aspect in these closures is their mostly complex arrangement which additionally requires undesirable constructional changes to the lid region of the can.

A further group of closure means for beverage cans consists of a pull tab which is fastened by means of a rivet connection to the can lid, with the handle part of the pull tab being arranged simultaneously as the closure means for the pouring opening, which after the opening of the pouring opening seals the pouring opening again by twisting and/or folding down the pull tab. Such elements are shown, among other things, in DE 197 46 539 A1, DE 203 19 105 U1, EP 1 190 952 A2, EP 1 097 086 B1 and EP 0 433 502 A1. These beverage cans all have a closure which is applied from the outside to the pouring opening and partly protrudes beyond the lid edge, so that the same can be removed inadvertently and the content of the can is exposed to the ambient environment.

GB 2 331 284 A finally describes a closure system, consisting of a pull tab for exposing a pouring opening and a closure means which is arranged on the bottom side of the lid of the can in the interior of the can, with a spring element pressing the closure means against the pouring opening. In order to enable the emptying of the can, parts of the closure means must be displaced against the pull tab. This closure means comes with the disadvantage that it is arranged in a highly complex manner and requires a change to the conventional lid of the can. A slightly simpler arranged closure device which also consists of several parts is disclosed in U.S. Pat. No. 3,889,842, which also requires a complex changed lid. Similar re-useable closure means are described in U.S. Pat. Nos. 4,746,032 A and 4,345,695.

The tightness of the reclosed beverage can pose a further problem for reclosable containers of the kind mentioned above. Especially in the case of a prolonged storage of the as yet unopened can, there may be problems with the sealing elements when they are subjected to mechanical stresses during the storage period or remain in a state of tension.

It is therefore the object of the invention to eliminate the disadvantages of the state of the art as described above and to provide a lid for a beverage can which includes a secure, and especially fluid-tight, closure system for re-closing the can and which can preferably be mounted in a simple and cost-effective manner in conventional lids.

SUMMARY OF THE INVENTION

This object is achieved in accordance with the invention with the lid including at least one recess for accommodating at least one sealing means between the lid and the cover. It is provided in accordance with the invention that the at least one sealing means remains in the planar recess in a relaxed manner, so that no tension forces act upon the preferably annular sealing means which might cause premature wear and tear to the same.

In a preferred embodiment of the invention the at least one sealing means is preferably arranged in a non-detachable manner on the cover. It is provided in this case for example that the sealing means is arranged in a receiver of the cover and remains in the recess of the lid as long as the beverage can is sealed.

It is especially preferred that in a first position of the cover relative to the lid, the at least one sealing means is arranged in the at least one recess, while the outlet opening is originally sealed. In this state the sealing means is without any function.

It is provided in a second position of the cover relative to the lid that the at least one sealing means is arranged in the region of the exposed outlet opening while the outlet opening is sealed by the cover. In this position of the cover the sealing means fulfills its intended purpose, which is sealing the exposed outlet opening of the lid against the cover in order to reclose the beverage can in a fluid-tight and/or gas-tight manner.

It is provided in a further embodiment of the invention that the cover can be fastened to the liquid container by way of at least two snap hooks which engage behind the flanged edge in sections and independently from one another. The cover can be twisted more easily relative to the lid with the help of these snap hooks, which bring the cover into engagement with the lid only in sections because the frictional resistance is reduced.

An especially easy attachment of the cover to the lid and therefore to the beverage can is achieved when the at least two snap hooks are movably arranged on the cover. It is preferably provided for this purpose that the snap hooks are produced integrally with the cover and are connected to the cover in an articulated manner by way of a tapering in the material.

It is provided in a further variant of the invention that the lid is made at least partly of plastic. This lid, which is preferably made of stable plastic, has the same properties as one made of metal. It is cheaper to produce however.

In order to facilitate the first opening of the beverage can, it is provided in a further embodiment of the invention that at least one press-open cam is arranged on the outlet opening, which cam comprises at least one press-open element which is preferably arranged in a hook-like manner. This hook-like press-open element engages in the tearing line enclosing the outlet opening and thereby simultaneously effects pressure compensation which facilitates further opening of the outlet opening.

It is provided in an especially preferred manner that at least one element is provided for determining the position of the cover in relation to the lid. As a result, the cover can be brought by the user to the precisely intended position, so that problems concerning the tightness of the reclosed beverage can can be prevented.

The element for determining the position of the cover in relation to the lid is preferably arranged as an index cam arranged on the lid which can engage in at least one recess of the cover. It is provided as an alternative to this that the cover comprises at least one groove or recess in which an elevation or a cam can engage which is arranged on the cover. In a further variant, the position of the cover is indicated alternatively or cumulatively by a signal, especially a clicking sound.

BRIEF DESCRIPTION OF THE DRAWINGS

The invention will be explained below by reference to non-limiting embodiments shown in the drawings, wherein.

DETAILED DESCRIPTION OF THE PREFERRED EMBODIMENTS

Figure 1A:
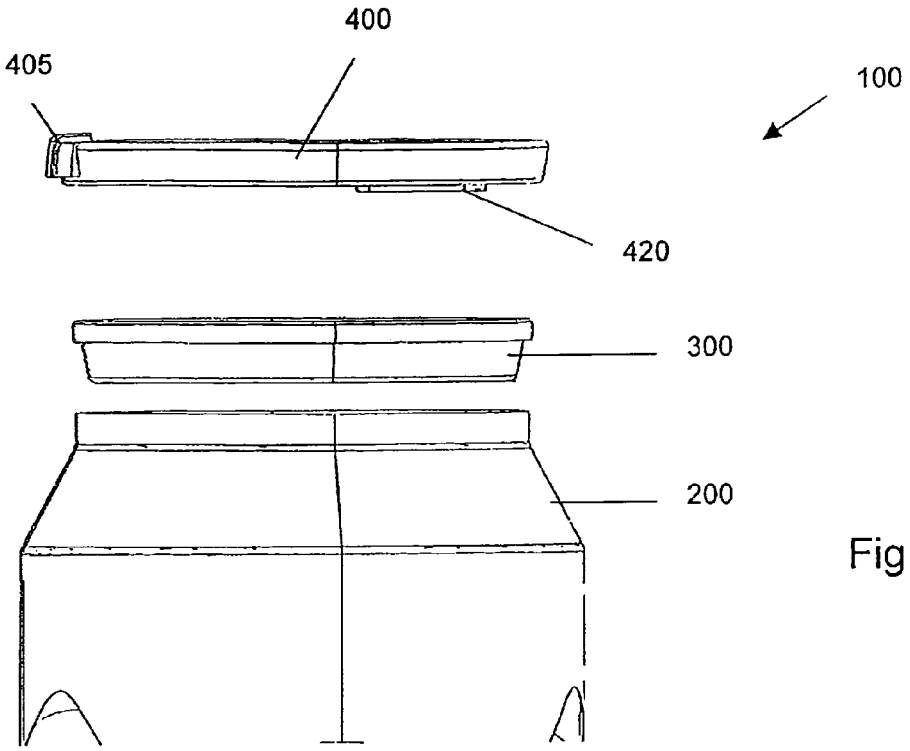
FIG. 1*a* to FIG. 1*c* show different exploded views of a reclosable closure.
Figure 1B:
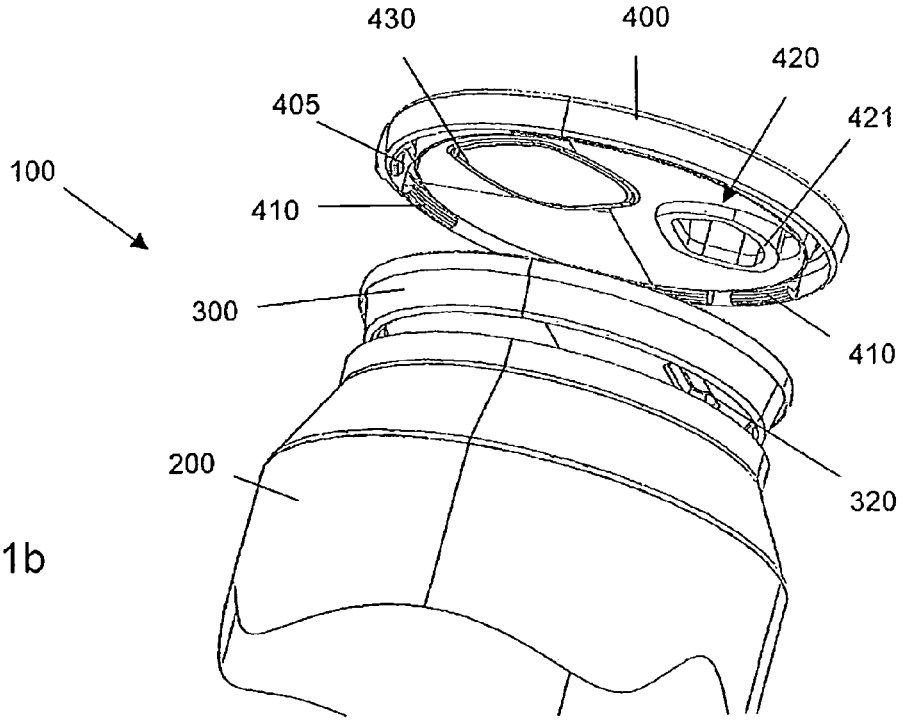
Figure 1C:
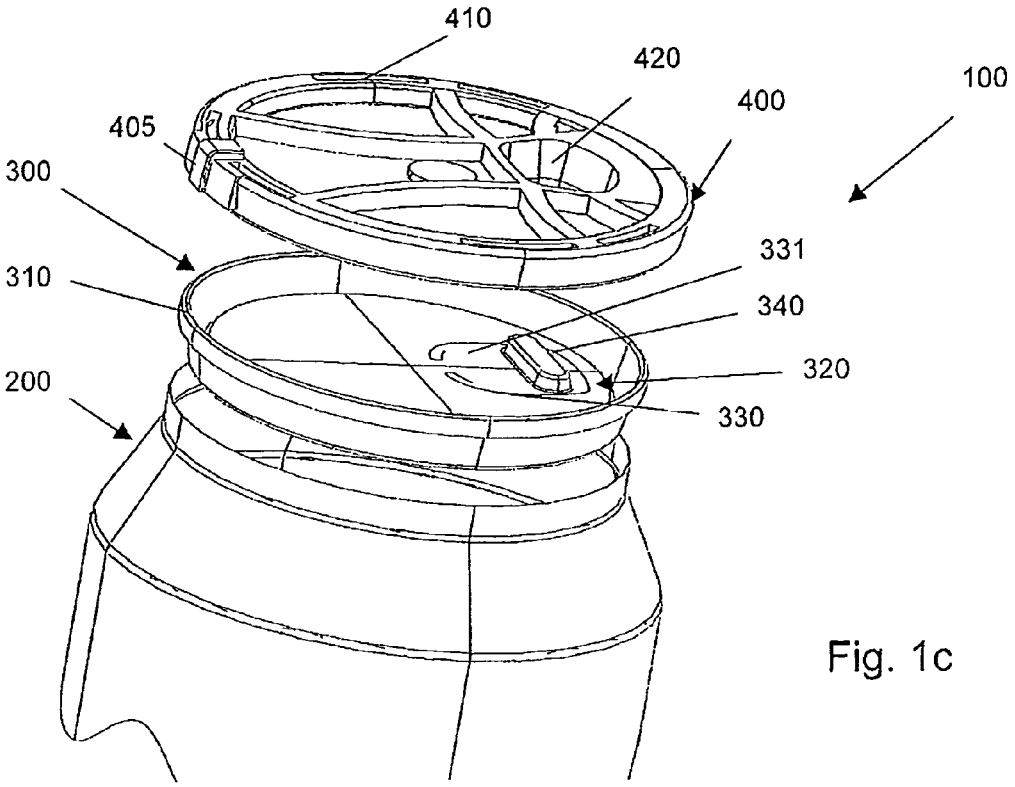

FIGS. 1*a* to 1*c* show different exploded views of a reclosable closure 100 for a beverage can 200. In this case, a beverage can 200 comprises a lid 300 on which a cover 400 is positioned. Mutually independent snap hooks 410 which are distributed over the circumference are provided for fastening the cover 400 to the lid 300, which snap hooks 410 engage with the beverage can 200 in the manner of a snap action beneath a flanged edge 310 of the lid 300. The cover 400 can be twisted more easily relative to the lid with the help of these snap hooks 410 which bring the cover 400 into engagement with the lid 300 only in sections because the frictional resistance has been reduced. The snap hooks 410 are made of plastic, as also preferably the entire cover 400, with the cover 400 being latched onto the flanged edge 310 after the lid 300 was flanged onto the beverage can 200. The snap hooks 410 are provided with an elastic configuration at their end facing the cover 400, e.g. by means of a tapering in the material along the outside edge of the cover 400, so that the snap hooks 410 are able to yield outwardly with their hook-like end by the pressure of the flanged edge 310 during the placement of the cover 400 which usually has a lower diameter than the lid 300 plus the flanged edge 310, and thereafter enclose the flanged edge 310 with their hook-like end. The hook-like ends of the snap hooks 410 can be arranged in such a way that a lifting of the cover 400 from the lid 300 is possible without destroying the cover 400 or the snap hooks 410. Alternatively, the snap hooks 410 can also engage in the flanged edge 310 in a non-detachable manner.

The cover 400 further comprises a drinking orifice 420 which when the drinking orifice 320 of the lid 300 of the beverage can 200 is opened encloses the same in a tight manner, so that when drinking from the beverage can 200 no fluid can reach the position between the lid 300 and the cover 400. In addition, sealing devices 430 are provided on the surface of the cover 400 facing the lid 300, which sealing devices are used to prevent any leakage of fluid through the drinking orifice 320 of the lid 300 when the beverage can 200 is reclosed.

Preferably, the drinking orifice 420 of the cover 400 is arranged to be smaller than the drinking orifice 320 in the lid 300 in order to enable venting of the beverage can 200. Since the drinking orifice 420 of the cover is frequently completely enclosed by the lips of the drinking person when drinking from the beverage can 200 and thereby a negative pressure may occur in the beverage can 200, the larger drinking orifice 320 allows venting of the beverage can 200, with the sealing elements 430 being arranged in the opened position (i.e. during drinking) in such a way that such venting is enabled by way of the drinking orifice 320 in the lid 300.

FIG. 1*c* is shows that the drinking orifice 320 of the lid 300 is still originally closed in the shown illustration. The drinking orifice 320 comprises tearing lines 330 which are arranged in the illustrated embodiment in the manner of a horseshoe. Furthermore, a cam 340 is arranged on the surface, which cam is formed in accordance with FIG. 1*b* as an embossed portion in the lid 300 which is usually made of sheet metal. Said cam 340 is used for the first opening of the lid 300 and the exposure of the drinking orifice 320, with the contact surface 421 of the drinking orifice 420 of the cover 400 (FIG. 4*a*) pressing against the cam 340 during the twisting of the cover 400, which contact surface 421 is arranged as an inclined portion for example, and thereby causes a tearing of the tearing line 330 and simultaneously inward folding of the lid region 331 into the beverage can 200, which lid region 331 is delimited by the tearing line 330. For this purpose, the cover 400 is twisted for such a time in a direction relative to the lid 300 until the drinking orifice 320 has been fully exposed. Thereafter, the cover 400 is preferably twisted in the opposite direction again until the drinking orifice 420 of the cover 400 substantially comes to lie above the exposed drinking orifice 320 of the lid 300 of the beverage can 200 in order to enable drinking from the beverage can 200 without leaking.

When the beverage can 200 is not emptied completely, the cover 400 is twisted to such an extent for reclosing the can that the seal 430 encloses the drinking orifice 320 of the lid 300 entirely and no fluid is able to leak from the beverage can 200. Markings or labeling can be provided on the surface of the cover 400 facing away from the lid 300 which designate the precise position of the cover 400 relative to the lid 300 in order to precisely define the opened or closed position of the cover 400 (not shown). Alternatively, devices can also be provided which indicate the achievement of a specific position by an acoustic signal, e.g. a clicking sound.

A gripper element 405 is further provided on the outside edge of the cover 400 which facilitates twisting of the cover 400 in the mounted state on the lid 300.

Figure 2:
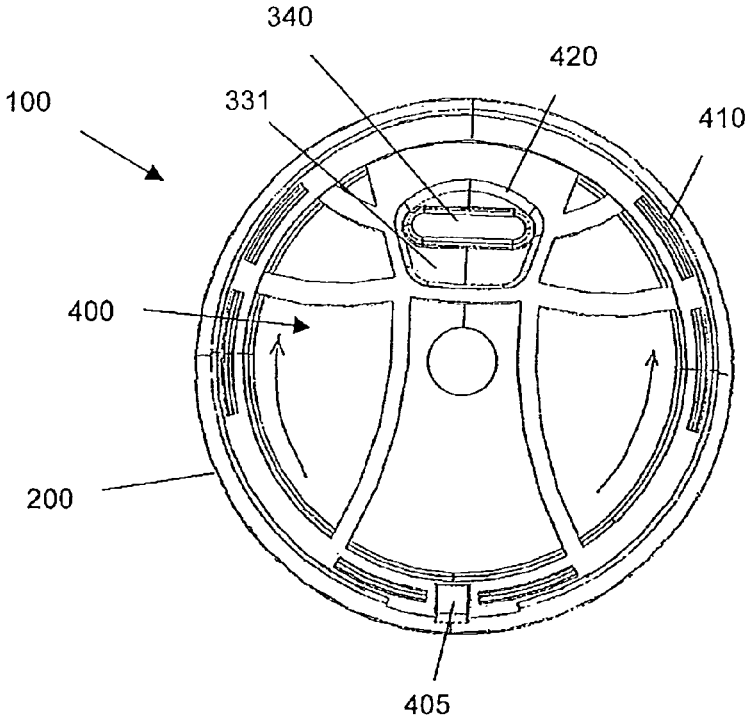
FIG. 2 shows the beverage can of FIGS. 1*a* to 1*c* with mounted lid and cover in a top view.

FIG. 2 shows the beverage can 200 with the mounted lid 300 and a further embodiment of the cover 400 in a top view. In this case, the can 200 is still closed, with the cam 340 protruding into the drinking orifice 420 of the cover 400. The drinking orifice 320 of the lid will be exposed in the manner as described above only by twisting the cover 400 in a direction indicated by one of the two directions illustrated by the arrows.

Figure 3A:
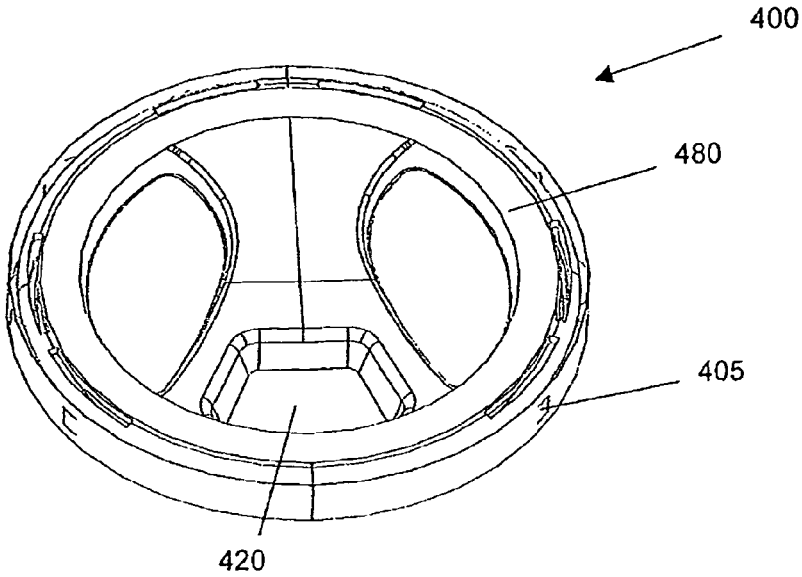
FIG. 3*a* to FIG. 3*c* show a further embodiment of the cover in accordance with the invention in different views.
Figure 3B:
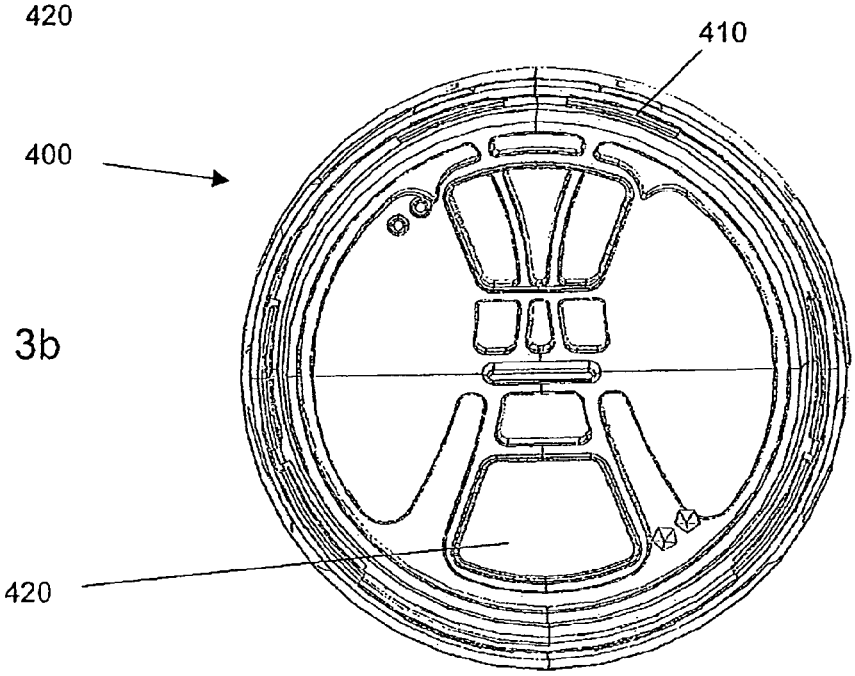
Figure 3C:
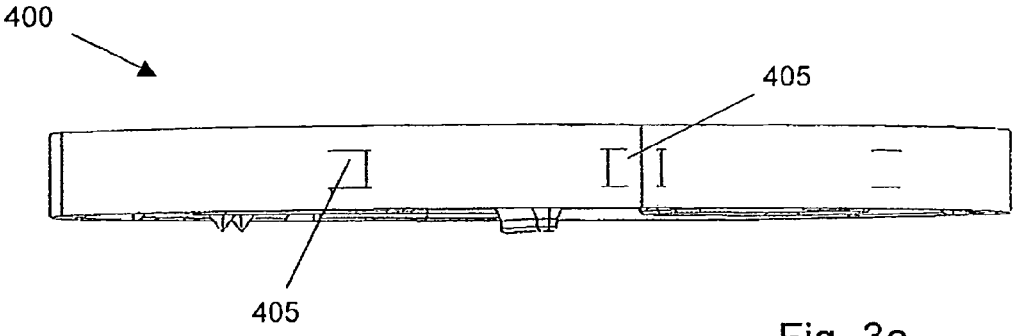

A further embodiment of the cover 400 in accordance with the invention is shown in FIGS. 3*a* to 3*c*. In this case too, the cover 400 is preferably made of stable plastic and comprises a drinking orifice 420. Furthermore, gripper elements 405 are provided on its outside edge in regular intervals, which gripper elements facilitate twisting of the cover 400. Snap hooks 410 are again arranged around the circumference on the bottom side of the cover 400 (FIG. 3*b*), with which the cover 400 is fastened to the lid 300 of a beverage can 200.

A gripping region 480 is preferably provided for the purpose of automated mounting of the cover 400 in accordance with the invention on a lid 300, which gripping region extends in an annular manner along the circumference of the cover 400 and is substantially arranged in a planar manner in order to enable a vacuum gripper to grip the cover 400.

Figure 4A:
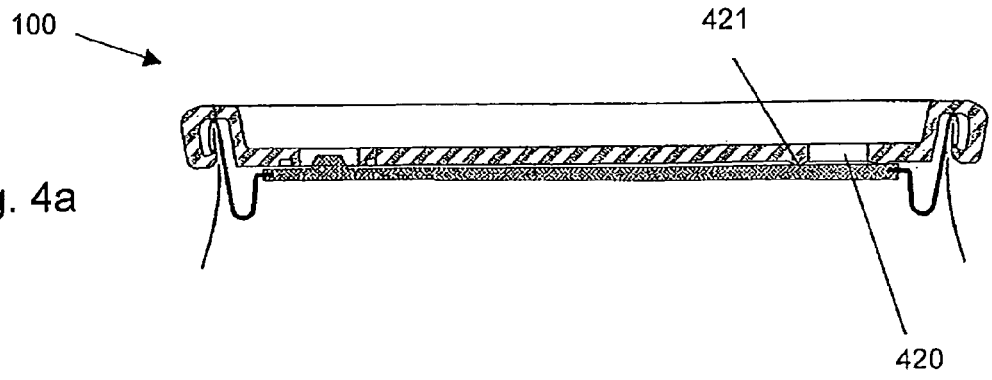
FIG. 4*a* shows a further variant of the invention in a sectional view with a closed drinking orifice.
Figure 4B:
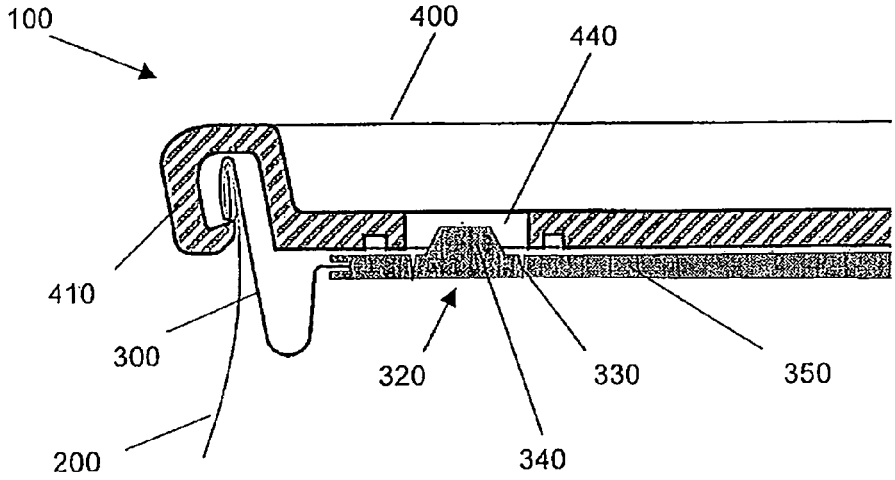
FIG. 4*b* shows a detailed view of the closure of FIG. 4*a;*

FIGS. 4*a* and 4*b* show a further variant of the invention in a sectional view with closed drinking orifice 320. A cam 340 again protrudes in this case into a recess 440 of the cover 400 and is delimited by tearing lines 330, with the lid 300 not being made entirely of metal in this embodiment. Instead, the planar region 350 on which the drinking orifice 320 is arranged is made of stable plastic. The cover 400 is twisted again for opening the beverage can 200, with the drinking orifice 420 of the cover 400 comprising contact surfaces 421 (as shown in FIG. 4*a*) which act upon the cam 340 during the opening of the drinking orifice 320 of the lid 300 and cause the tearing lines 330 to be torn open. It can also be provided that the lid 300 is made entirely of plastic.

Figure 5A:
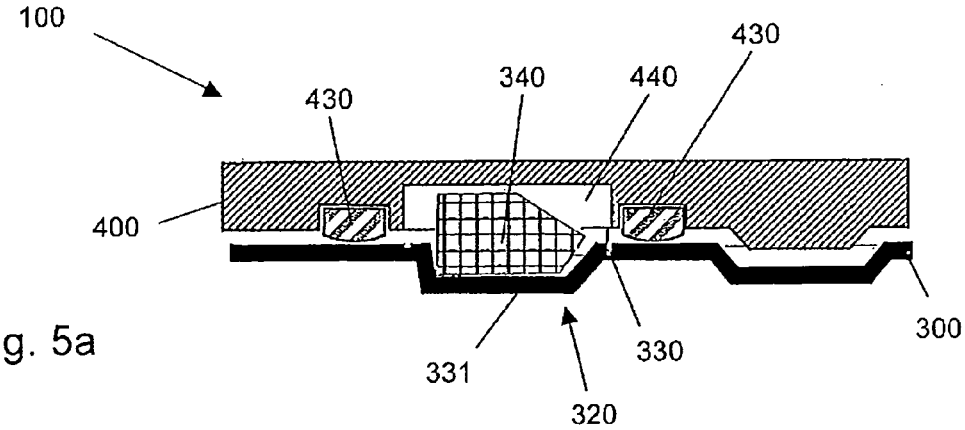
FIG. 5*a* shows a sectional view of a further embodiment of the closure in accordance with the invention.

FIG. 5*a* shows a further sectional view, on which a cam 340 which is attached by means of gluing for example is arranged on the lid region 331 delimited by the tearing lines 330 instead of a cam which is embossed into the material of the lid 300 or is arranged as an accumulation of material, and which protrudes into a recess 440 of the cover 400 as long as the beverage can 200 has not been opened and no twisting of the cover 400 has occurred. The recess 440 is enclosed at least partly by a seal 430 in this embodiment of the invention in order to prevent a loss of fluid during the reclosing of the beverage can 200 by twisting the cover 400.

Figure 5B:
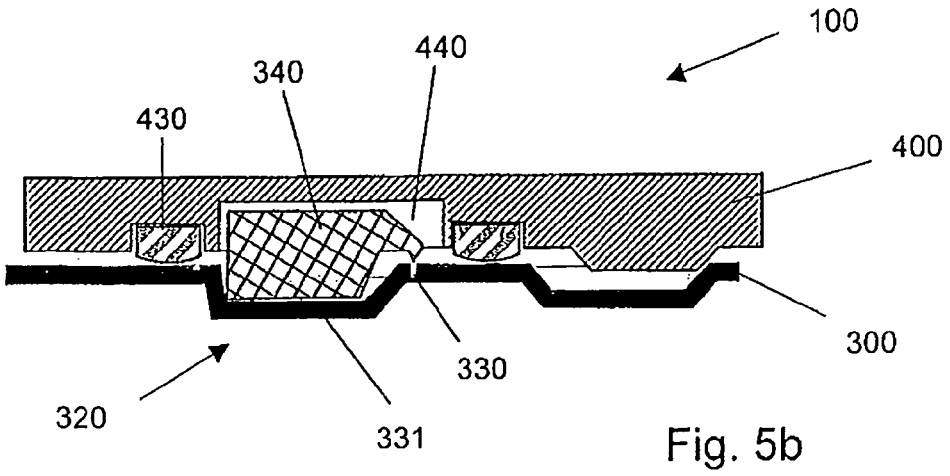
FIG. 5*b* shows a sectional view of a further embodiment of the closure in accordance with the invention.

In the variant as shown in FIG. 5*b*, the cam 340 additionally comprises a press-open element 345 which is integrally arranged with the cam 340. Under action of pressure on the cam 340 by twisting the cover 400, this hook-like press-open element 345 is pressed directly into the tearing line 330, so that the pressing opening of the tearing line 330 is facilitated in this embodiment of the invention through improved pressing open with pinpoint precision of even double tearing lines for example.

It can further be provided that press-open devices such as those shown in FIG. 5*b* for example or alternatively separate cams arranged in a substantially acute way on the side of the cover 400 facing the lid are supported with additional manual force when pressing open the tearing line 330, with a respective labeling being provided on the cover 400. For opening the beverage can 200 after the twisting of the cover 400 to a predetermined position (open position) the user must press a marked area of the cover 400 with one or several fingers in order to amplify the press-open forces of the press-open element by an additional manual vertical pressing force, which press-open forces act vertically as a result of the pretension occurring by the twisting of the cover 400.

Figure 6:
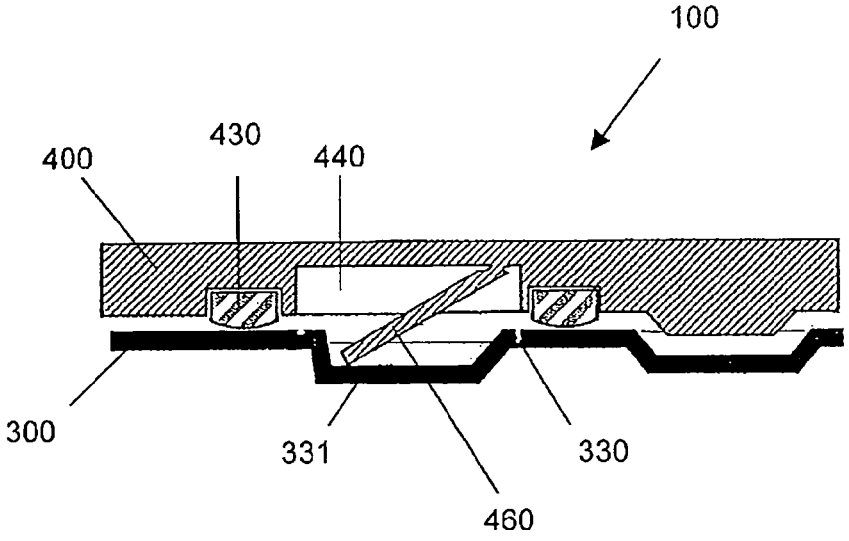
FIG. 6 shows a sectional view of a further embodiment of the closure in accordance with the invention.

An alternative opening mechanism is shown in FIG. 6, in which a lever element 460 is provided which is arranged in the recess 440 of the cover 400 and is in connection with the cover 400 in an articulated manner by way of a tapering in the material for example. When the cover 400 is twisted the lever element 460 is deflected in such a way that it acts upon the lid region 331 enclosed by the tearing lines 330 in such a way that the tearing lines 330 are opened and the lid region 331 is pressed into the interior of the beverage can 200. As a result, the lever element 460 not only acts as an opening mechanism but also as a bending mechanism for the region 331 delimited by the tearing line 331.

Figure 7A:
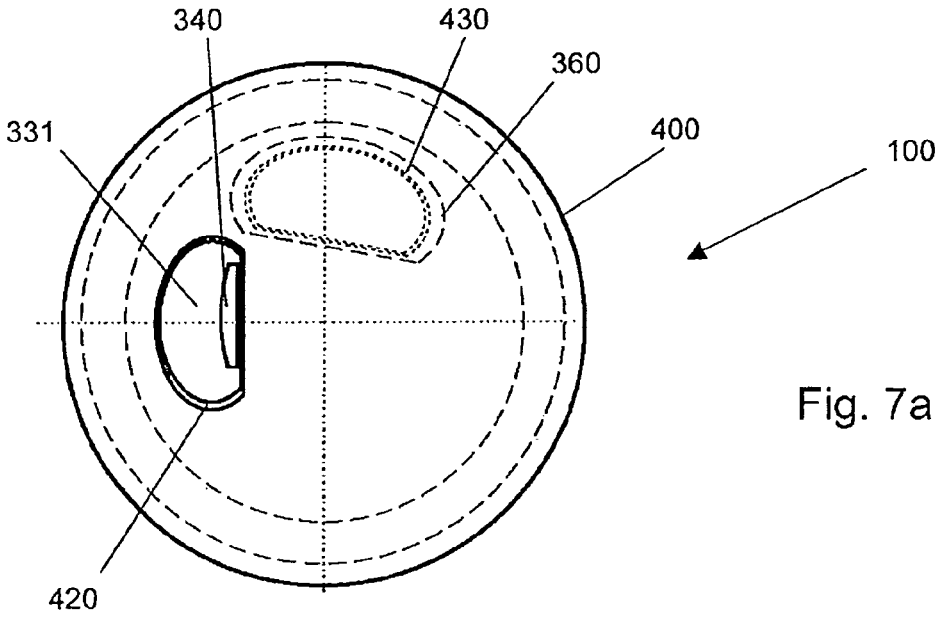
FIG. 7*a* shows a further variant of the invention in a top view in a first position of the cover with closed drinking orifice.
Figure 7B:
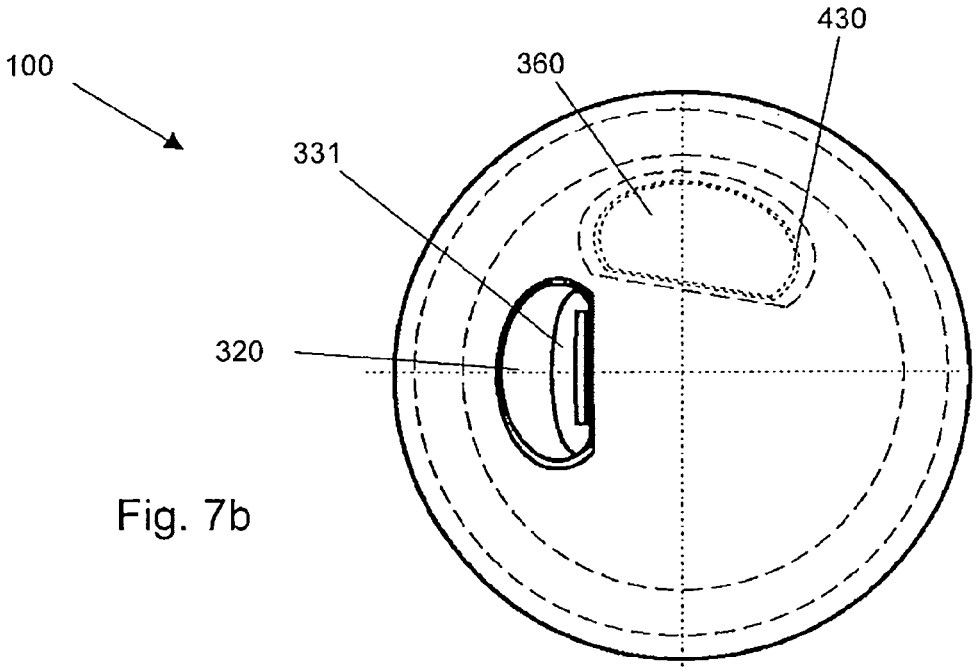
FIG. 7*b* shows the closure in the position of the cover of FIG. 7*a* in the opened state.
Figure 7C:
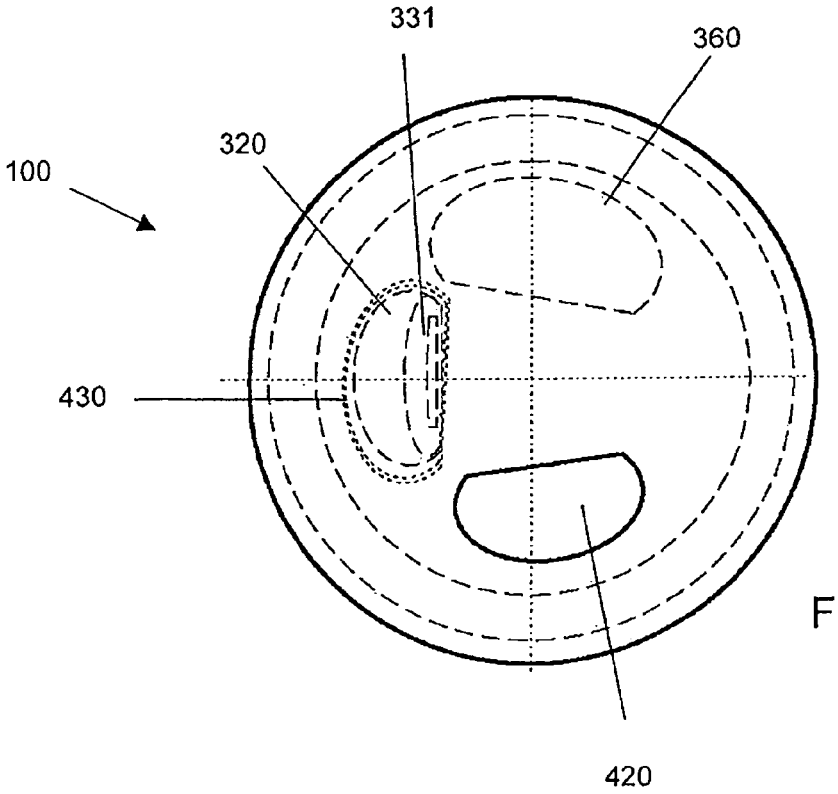
FIG. 7*c* shows the closure of FIG. 7*a* in a second position of the cover in the reclosed state.

The closure 100 is shown in different states in the embodiment of the invention as shown in FIGS. 7*a* to 7*c*. In FIG. 7*a* the beverage can 200 is still unopened. The seal 430 which is annular in this embodiment and which is part of the cover 400 lies in this case in a planar recess 360 of the lid 300. The cover is twisted to the position in which the drinking orifice 420 of the cover 400 is arranged above the lid region 331 which exposes the outlet opening 320 during opening.

The outlet opening 320 in the lid 300 is exposed by twisting the cover 400 in the manner as described above, with the lid region 331 being swiveled into the beverage can 200. The seal 430 remains in the recess 360 in this case (FIG. 7*b*).

Only when the beverage can 200 is reclosed will the seal 430 be arranged around the outlet opening 320 by twisting the cover 400, so that any leakage of the content of the can especially between the cover 400 and the lid will be prevented.

Figure 8A:
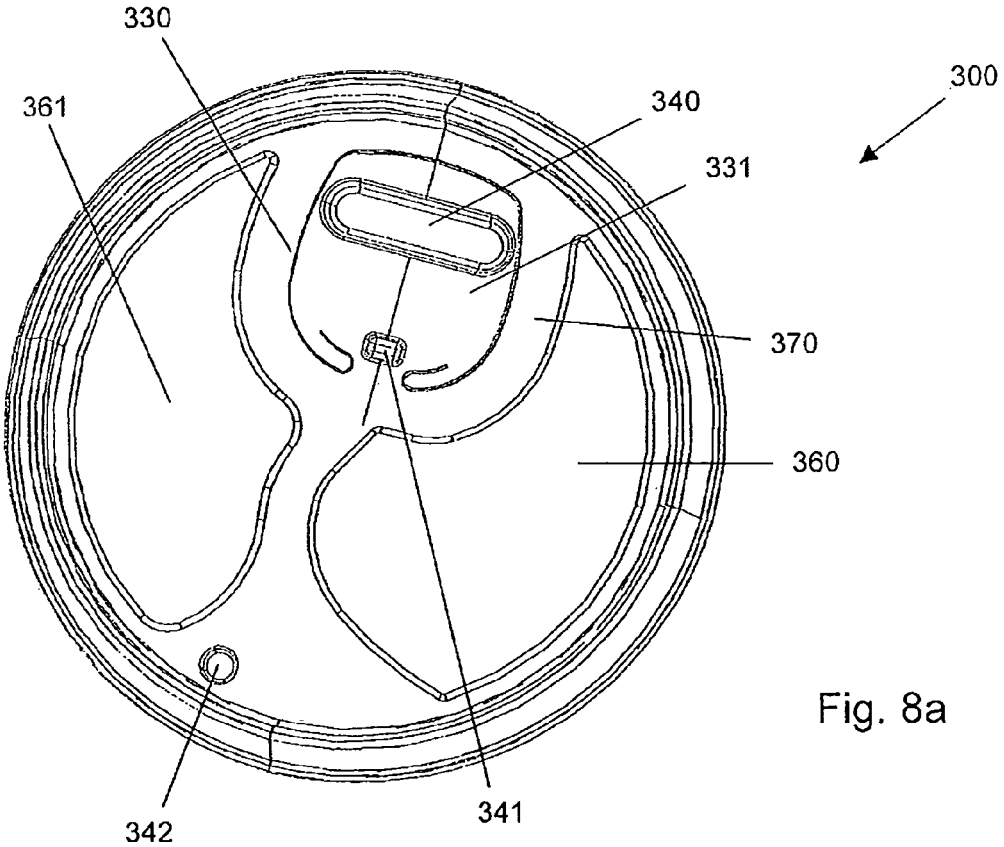
FIG. 8*a* shows a perspective view of a further variant of a lid.
Figure 8B:
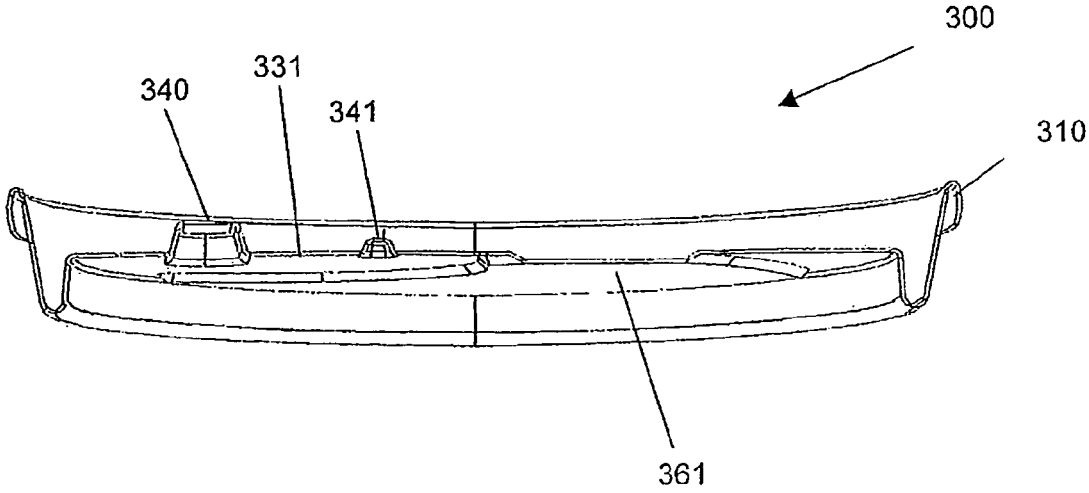
FIG. 8*b* shows a sectional view of the lid of FIG. 8*a*.

FIGS. 8*a* and 8*b* show a further lid 300, preferably made of aluminum, with an opening cam 340 and a folding cam 341 being provided in the region 331 of the lid 300 which is delimited by the tearing line 330, which cams are preferably embossed into the metal of the lid 300. The opening cam 340 protrudes at a higher level from the plane of the lid than the folding cam 341 because a contact surface 421 (FIG. 4*a*) of the cover 400 which cooperates with the opening cam 340 exerts a larger force on the opening cam 340 during the twisting of the cover 400 for example in order to open the tearing line 331, whereas a lower force via the folding cam 341 causes inward folding of the lid region 331 into the beverage can 200 after the opening of the tearing line 330. As third so-called index cam 342 is arranged outside of the lid region 331 and engages into recesses of the cover 400 at specific positions during the twisting of the cover 400 in order to thereby ensure its precisely defined opened position and closed position. It can similarly be provided that instead of an index cam 342 in the lid 300 a recess or a groove is arranged, while the cover 400 comprises an elevation or cam which engages in the recess or groove at specific rotational positions.

The lid 300 further comprises two planar recesses 360, 361 which are separated from one another by way of a sealing region 370 protruding from the plane of the lid. This sealing area 370 cooperates in the assembled state with the cover 400 in such a way that content of the beverage can 200 can reach the region between the lid 300 and the cover 400 and/or seep out of the sealed beverage can 200 neither in the opened position (e.g. during drinking) nor during the reclosing of the beverage can 200 in the closed position. Furthermore, this embossed sealing region 370 produces a mechanical stiffening of the lid 300.

A sealing means (not shown), preferably an elastomeric seal which is arranged in the cover 400, rests in the recesses 360, 361 in their delivery state (i.e. before the first opening of the beverage can 200), so that in the usually long period of storage before the first opening of the beverage can 200 the seal will be stored in a relaxed manner. This leads to the advantage that in this position there are hardly any or only low mechanical loads acting on the sealing means, so that no tensional losses and resulting reductions in the tightness during use will occur.

Elastic plastic materials are preferably considered as sealing materials, wherein the sealing means can be arranged in an annular or planar way.

The invention claimed is:

1. A reclosable closure of a liquid container comprising a lid that closes the liquid container by way of a flanged edge and comprising a cover, with the lid having an outlet opening which can be exposed by twisting the cover arranged on the lid, wherein the lid comprises at least one recess for accommodating at least one sealing means between the lid and the cover, wherein the cover can be fastened to the liquid container by way of at least two snap hooks which engage behind the flanged edge in sections and independently from one another, and wherein the snap hooks are produced integrally with the cover and are in connection with the cover in an articulated manner by way of a tapering in the material.

2. The closure according to claim 1, wherein the at least one sealing means is non-detachably arranged on the cover.

3. The closure according to claim 1, wherein in a first position of the cover relative to the lid the at least one sealing means is arranged in the at least one recess while the outlet opening is originally sealed.

4. The closure according to claim 3, wherein in a second position of the cover relative to the lid the at least one sealing means is arranged in the region of the exposed outlet opening while the outlet opening is sealed by the cover.

5. The closure according to claim 1, wherein the at least two snap hooks are movably arranged on the cover.

6. The closure according to claim 1, wherein the lid is made at least partly of plastic.

7. The closure according to claim 1, wherein at least one press-open cam is arranged on the outlet opening, which cam comprises at least one press-open element.

8. The closure according to claim 1, wherein that at least one element is provided for determining the position of the cover relative to the lid.

9. The closure according to claim 8, wherein the element for determining the position of the cover relative to the lid is arranged as at least one index cam which is arranged on the lid and which can engage in at least one recess of the cover.

10. The closure according to claim 8, wherein for determining the position of the cover relative to the lid the lid comprises at least one groove or recess in which at least one elevation or cam can engage which is arranged on the cover.

11. The closure according to claim 8, wherein for determining the position of the cover relative to the lid the position of the cover is indicated by an acoustic signal.

* * * * *